US009208759B2

(12) United States Patent
Millender, Jr.

(10) Patent No.: US 9,208,759 B2
(45) Date of Patent: Dec. 8, 2015

(54) COMPOUND-RESONANCE DRIVER (CRD) BASS ENHANCEMENT SYSTEM

(71) Applicant: Samuel Earl Millender, Jr., Pinole, CA (US)

(72) Inventor: Samuel Earl Millender, Jr., Pinole, CA (US)

( * ) Notice: Subject to any disclaimer, the term of this patent is extended or adjusted under 35 U.S.C. 154(b) by 15 days.

(21) Appl. No.: 14/333,428

(22) Filed: Jul. 16, 2014

(65) Prior Publication Data

US 2015/0020673 A1 Jan. 22, 2015

Related U.S. Application Data

(60) Provisional application No. 61/846,751, filed on Jul. 16, 2013.

(51) Int. Cl.

| | |
|---|---|
| ***G10H 3/00*** | (2006.01) |
| ***G10D 13/02*** | (2006.01) |
| ***G10D 3/02*** | (2006.01) |
| ***H04R 1/28*** | (2006.01) |

(52) U.S. Cl.
CPC ..... *G10D 13/021* (2013.01); *G10D 3/02* (2013.01); *H04R 1/2834* (2013.01)

(58) Field of Classification Search
USPC ..... 84/294
See application file for complete search history.

(56) References Cited

U.S. PATENT DOCUMENTS

| | | | | |
|---|---|---|---|---|
| 7,476,794 | B2 * | 1/2009 | May, Jr. | G10D 13/021 84/411 R |
| 7,582,820 | B2 | 9/2009 | Millender et al. | |
| 7,687,695 | B2 * | 3/2010 | DeJule | G10D 3/046 84/270 |
| 7,928,303 | B2 | 4/2011 | Millender et al. | |
| 7,932,452 | B2 * | 4/2011 | Chen | G10D 13/027 84/411 R |
| 7,968,780 | B2 | 6/2011 | Millender et al. | |
| 8,247,678 | B1 * | 8/2012 | Ivy | G10D 3/00 84/291 |
| 8,294,013 | B2 | 10/2012 | Lento | |

* cited by examiner

*Primary Examiner* — Christopher Uhlir
(74) *Attorney, Agent, or Firm* — Steven A. Nielsen; www.NielsenPatents.com

(57) ABSTRACT

A compound resonance driver or CRD may be used to enhance the tonal qualities of a bass drum system or other sound system. A CRD may comprise a flex ring having two hinge pieces. The flex ring may further comprise a plurality of magnets and the flex ring may be easily folded and placed in a drum and then unfolded. A fixed circular component with a complementary magnet orientation may secure the flex ring. The fixed circular component may be attached to outwardly facing components that resonate or otherwise improve upon the sound of a drum or any sound producing, or sound shaping device or instrument, encompassing properties of an acoustic enclosure. The mass and shape of the CRD may increase the excursion of a drumhead. This longer excursion produces a more natural low frequency waveform.

8 Claims, 24 Drawing Sheets

COMPOUND-RESONANCE DRIVER (CRD) BASS ENHANCEMENT SYSTEM

CROSS-REFERENCE TO RELATED APPLICATIONS

This is a utility application that claims the benefit of and is based upon U.S. Patent Application Ser. No. 61/846,751 filed on Jul. 16, 2013. This related application is incorporated herein by reference and made a part of this application. If any conflict arises between the disclosure of the invention in this utility application and that in the related provisional application, the disclosure in this utility application shall govern. Moreover, the inventor(s) incorporate herein by reference any and all patents, patent applications, and other documents hard copy or electronic, cited or referred to in this application.

BACKGROUND OF THE INVENTION (1) Field of the Invention

The invention generally relates to acoustic musical instruments. More particularly, the invention relates to means and methods of enhancing the sounds produced by a drum or drum system with focus on bass drums.

(2) Description of the Related Art

Other bass drum enhancement systems are known in the related art. For example, U.S. Pat. Nos. 7,582,820; 7,928,303; and 7,968,780 by Millender et al disclose various drum attachments. U.S. Pat. No. 8,294,013 by Lento discloses an insert with sidewalls. While useful for their intended purposes, the known related art fails to provide bass drum enhancement is a simple and cost effective system. Thus, there is ample room in the related art for the disclosed embodiments.

BRIEF SUMMARY OF THE INVENTION

The present invention overcomes shortfalls in the related art by presenting an unobvious and unique combination and configuration of methods and components to modify existing drum systems to produce lower frequencies with greater amplitude.

Disclosed embodiments includes means and methods of modular or other systems integrated into existing bass drums to enhance sound quality, the adjust sound attributes, assist in recording and amplification and other features. Disclosed Modulated Compound Resonance Drivers or ("MCDRs") or Compound Resonance Drivers ("CRDs" may be composed of various components and may be attached to a batter drum head and/or a resonant drum head. Various means of attachments are disclosed such that the disclosed embodiments may seamlessly integrate with existing drum systems.

Other disclosed embodiments include the application or attachment of a CRD to a woofer of a sound speaker or guitars and other musical instruments.

Disclosed embodiments include various CRD diaphragm shapes, various CRD configurations with or without various spring or isolation elements and with one or more diaphragms. Disclosed excursion extenders and quick stick risers may assist in achieving various sound qualities. Quick connect attachment rings, discs and methods assist in retrofitting existing bass drum systems.

Various strike attachments also assist in achieving various sound improvements. A sonic radiator dish may be mounted directly to a drum head, excursion extender or other component and may further adjust sound output. Various versatile multi-disks include weight rings, rubber reeds, air holes and other features to further augment sound output. A sonic Iris multi-disk attachment further augments sound output.

Moreover, disclosed CRDs may use one or more tuned resonating chambers as a complete or partial driver. A CRD may act as an addition or replacement to a batter head and/or a resonant head. A CRD may increase air flow and adjust amplitude.

Disclosed excursion extenders act as versatile suspension devices that may support and accept a CRD and other components.

A magnetic system includes a new articulated inner ring mount having a hinge system to facilitate insertion into the inner void of a drum. In the preferred embodiment, the hinges align with the center point of the drum.

Disclosed embodiments include the artful use of moveable weights used to adjust the tonal qualities of a drum. The moveable weights may be attached to a pendulum, wire, string, spring or with structure. A star shaped elastic support system may be used to further enhance to tonal modifications made to a drum or other instrument.

A CRD may function as a type of sound board. A CRD may create a modulated resonance, or frequency modulated resonance or tone.

The CRD may embody a principle known as Millender resonance. Millender Resonance may be a condition where: (A) a membrane or a resilient member whose pitch is a product of its tension and having (B) a resonating, oscillating, or vibrating mass whose affixation to (A), shifts the tension, and therefore the pitch of (A), in some direct and or indirect relation to the vibratory rate of (B). This may thus create (C), a CRD. (C) may function as a(B), and be applied to an (A), thereby creating [(C) squared]. [(C) squared] may be equivalent to adding a C.R.D. to a drum head. Similarly, a C.R.D. may be created, by adding a C.R.D. to a drum head. A CRD may also be a device that receives energy or inertia from a system, and returns energy or inertia to said system, forming a loop.

These and other objects and advantages will be made apparent when considering the following detailed specification when taken in conjunction with the drawings.

REFERENCE NUMERALS IN THE DRAWINGS

Figure 1:
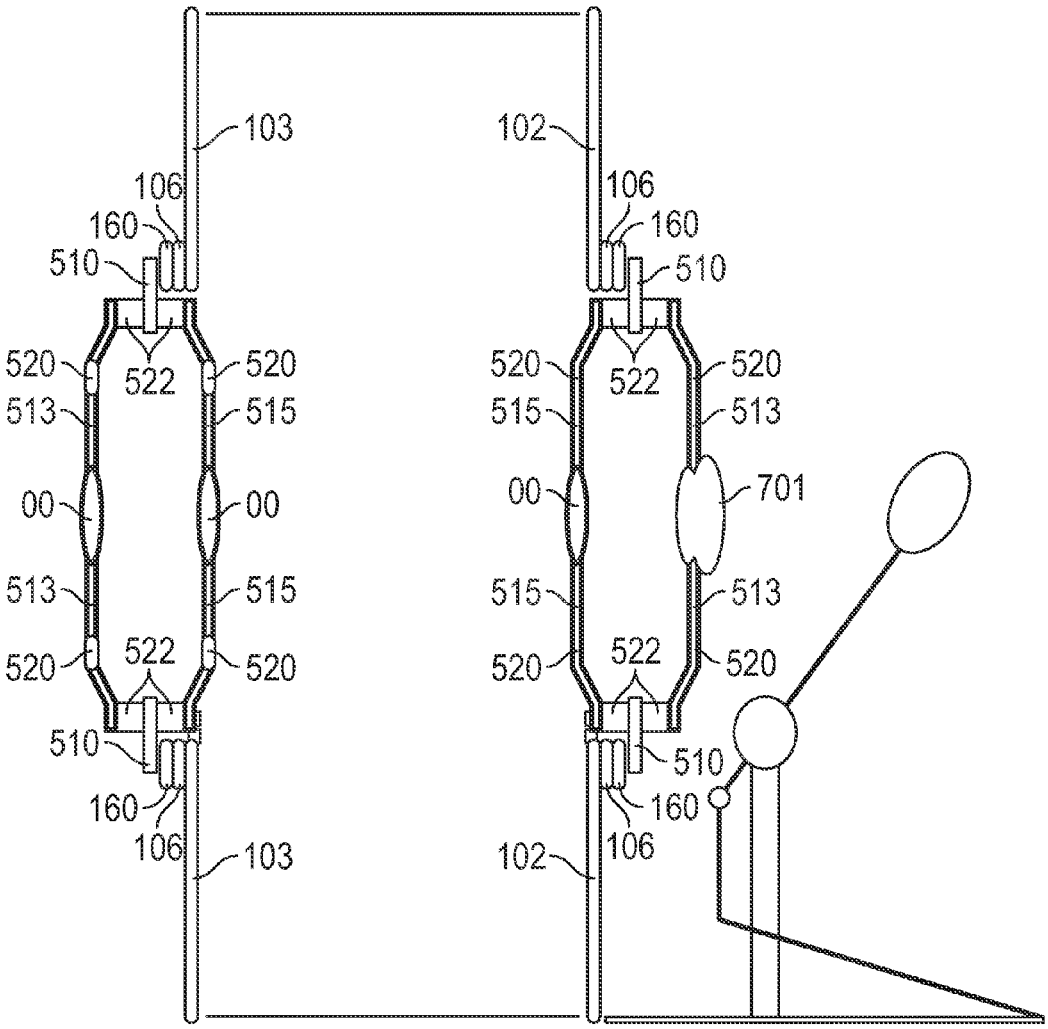
FIG. 1 depicts a MCRD or CRD mounted upon a batter and a resonant head of a bass drum

00 opening or void within a batter drum head or resonant drum head
100-A excursion extender—perspective view
100-B excursion extender—sectional view
100-C excursion extender with surgical rubber attachment holder
110 outside ring
130 inside support ring/disc
140 rubber attachment holder
150-C versatile multi-disk attachment
102 batter drum head
103 resonant drum head
106 template ring
110 outside ring
120 neoprene
130 inside support ring or disc
140 rubber attachment holder
150-A-1 solid multi disk attachment
150-B-00 void within disk
150-B-1 two inch void multi-disk attachment
150-C versatile multi-disk attachment
150-C-1 four inch void multi-disk attachment, with opening 150-C-00
150-D-1 EQ multi-disk attachment
150-D-2 air voids
150-E-1 rubber reed multi-disk attachment
150-E-2 rubber reed
150-E-00 void or opening within rubber reed
150-F-1 rubber dam multi-disk attachment
150-F-2 rubber dam
150-F-00 void or hole
150-G-1 weight ring
150-H-1 weight disk
160 adhesive
200-A quick stick riser
200-B side view of a quick stick riser
240 quick stick riser body
247 slot or void for mic cable
248 mic connector
260 adhesive related to quick stick riser
300 quick connect system
330 quick connect disc
340 rubber overlap
350 base ring disc
360 base ring related adhesive
370 bonding point between rubber and disk
400 sonic radiator dish
420 dish
500 MCRD—adjustable mounted on a speaker cabinet over a port
510 support frame
510-D support frame with slotted end disk insert
513 external diaphragm wall
513-B external adjustable diaphragm wall
515 internal diaphragm wall
517-A center diaphragm A
517-B center diaphragm B
517-C center diaphragm C, single with smaller hole or void
517-D center diaphragm D, solid air flows past edge suspension
520 spring suspension foam
522 isolation foam
524 air passing suspension
580 external diaphragm screw flange adjustment
580-B fixed flange
590 internal diaphragm fixed flange
600 sonic iris
610 outer ring
620 iris film, sometimes made of surgical rubber, neoprene, other material with similar elastic properties
630 inside adjustment ring
635-A adjustment ring guide spar
635-B adjustment ring spar
637 numbered spar locks
701 beater plug
710 support frame
720 membrane
725 lugs
730 membrane retainer
800 speaker in general
810 speaker cabinet
820 tweeter
830 woofer
840 port
900 sonic variable valve multi-disk attachment
900-A main disk
900-B rotating valve
901 pivot point screw on axis
911 100% open mark
912 100% closed mark
915 corresponding air valves
920 axis
1001 outside ring
1002 membrane
1003 outside ring B

1004 EVA foam ring
1005 outside ring
1006 adhesive ring
1007A neoprene gasket
1007B magna ring
1008 center ring B
1009 center ring C
1010 neodymium magnets
1100 guitar
1105 deck or body of guitar
1110 bridge of guitar
1115 strings of guitar
1120 magnets of a guitar embodiment
1125 membrane of a guitar embodiment
1130 center ring of a guitar embodiment
1135 outside ring of a guitar embodiment
1200 magnetic coupling embodiment
1210 superior magna ring mount
1212 magnets disposed within superior magna ring mount 1210
1220 exterior magna ring mount
1222 magnets disposed within exterior magna ring mount 1220
1225 membrane of exterior manga ring mount 1220
1230 interior magna ring mount
1232 magnets disposed within interior magna ring mount 1230
1250 drum head
1251 center point of drum head
1260 drum shell
1270 hoop of drum
1300 magna flex ring
1302 magnets disposed within a magna flex ring 1300
1305 hinges of magna flex ring
1307 hinge axis aligned to hinges and center point 1251 of drum head
1400 moveable weigh embodiment
1402 magnet attached to spring 1415 or other member
1405 moveable weight
1406 stationary weight
1407 adhesive
1408 pivot component between spring and magnet post 1409
1409 magnet post
1410 pendulum
1415 spring or other elastic member
1417 tension screw
1418 tension nut
1420 weight frame
1423 horizontal leg of weight frame 1420
1425 vertical leg of weight frame 1420
1430 body of Compound-Resonance Driver or CRD
1435 spring or sting linkage 1430
1500 rubber, elastic, spring or other resilient member used to secure a center weight frame
1505 center weight frame
1507 frame

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

Any and all the above references and U.S. patents and applications are incorporated herein by reference. Aspects of the invention can be modified, if necessary, to employ the systems, functions and concepts of the various patents and applications described above to provide yet further embodiments of the invention.

These and other changes can be made to the invention in light of the above detailed description. In general, the terms used in the following claims, should not be construed to limit the invention to the specific embodiments disclosed in the specification, unless the above detailed description explicitly defines FIG. 1 depicts CRD or MCRD embodiments attached to both a batter drum head and resonant drum head. Such embodiments may include a batter drum head 102 having an opening 00 and/or a resonant drum head 103 defining an opening 00. A CRD or Compound-Resonance Driver may comprise a template ring 106, adhesive 160, support frame 510, external diaphragm wall 513, internal diaphragm wall, spring suspension foam 520, external diaphragm screw flange adjustment 580, internal diaphragm fixed flange 590 and a beater plug 701.

Figure 2:
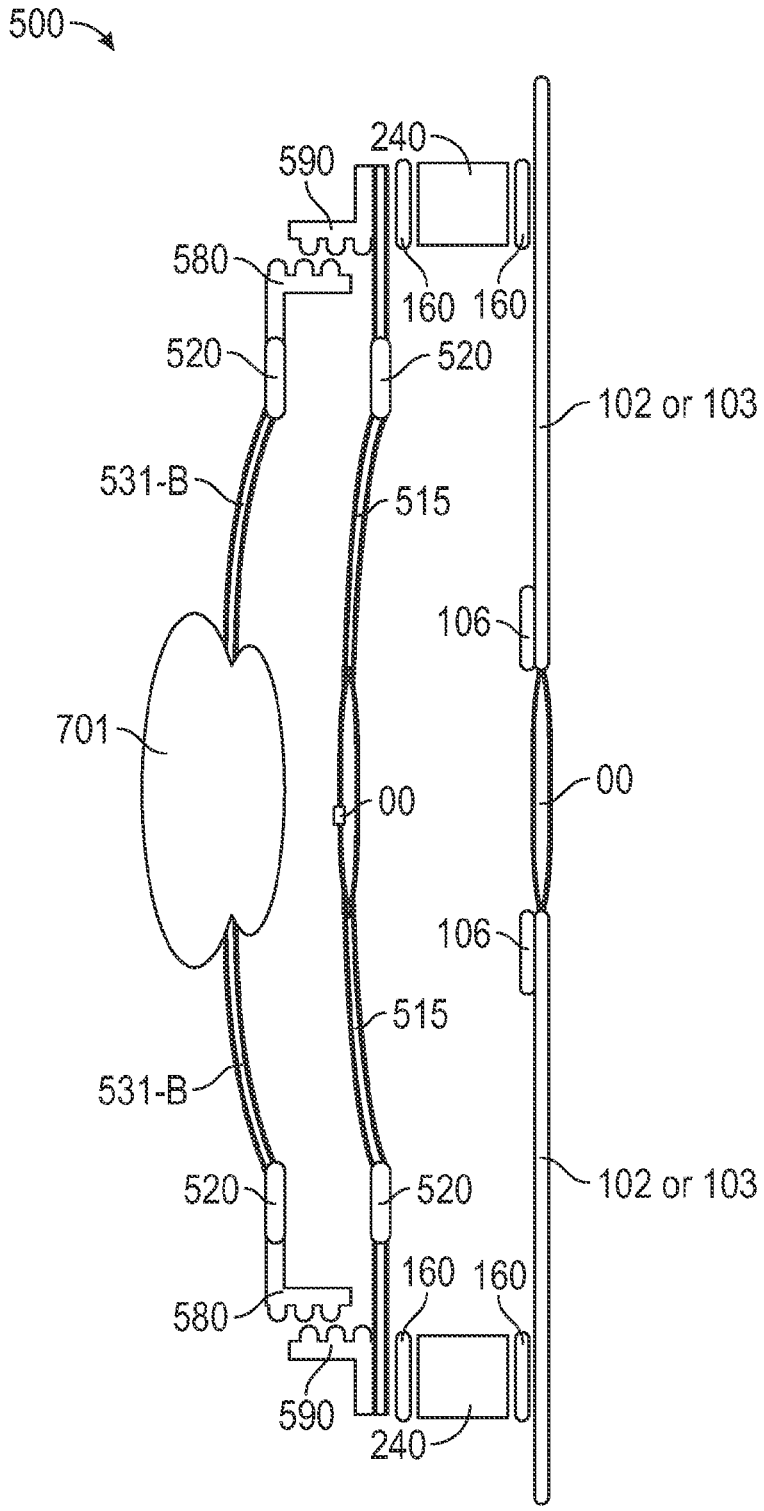
FIG. 2 depicts a modulated compound resonance driver or CRD with adjustable features

FIG. 2 depicts a disclosed CRD having a beater plug 701, internal diaphragm wall 515, quick stick riser body 240, quick-stick riser body 240, external adjustable diaphragm wall 513-B, spring suspension foam 520, external diaphragm screw flange adjustment 580 and internal diaphragm fixed flange 590.

Figure 3:
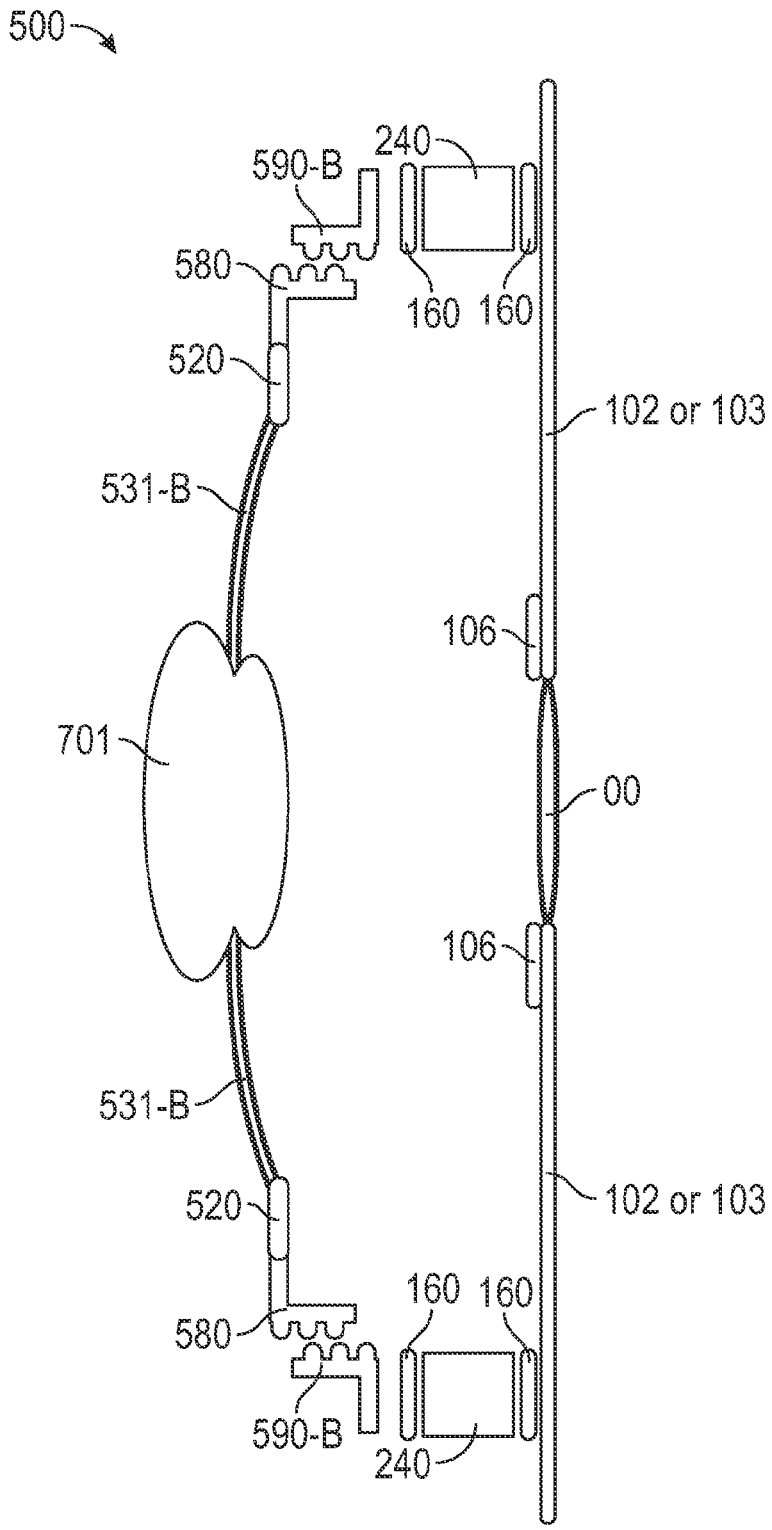
FIG. 3 depicts a modulated compound resonance driver with adjustable features

FIG. 3 depicts the CRD of FIG. 2 sans the internal diaphragm wall.

Figure 4C:
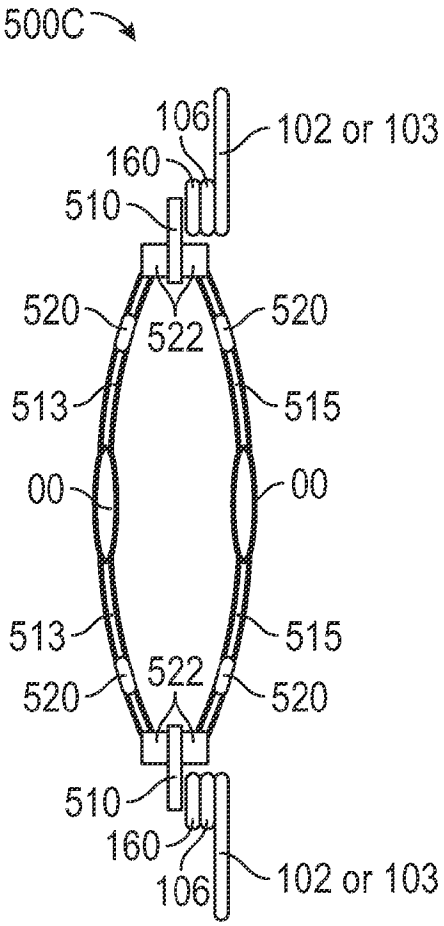
FIGS. 4A to 4C depict a various MCRD or CRD configurations
Figure 4B:
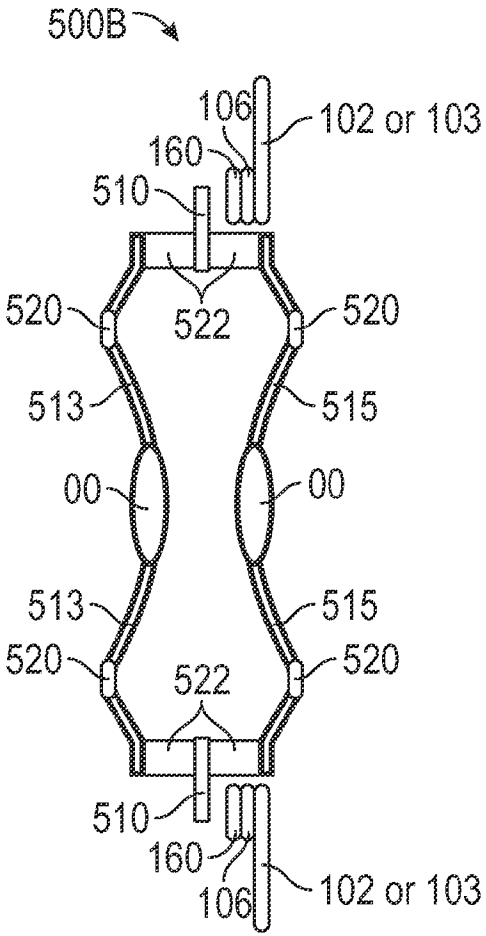
Figure 4A:
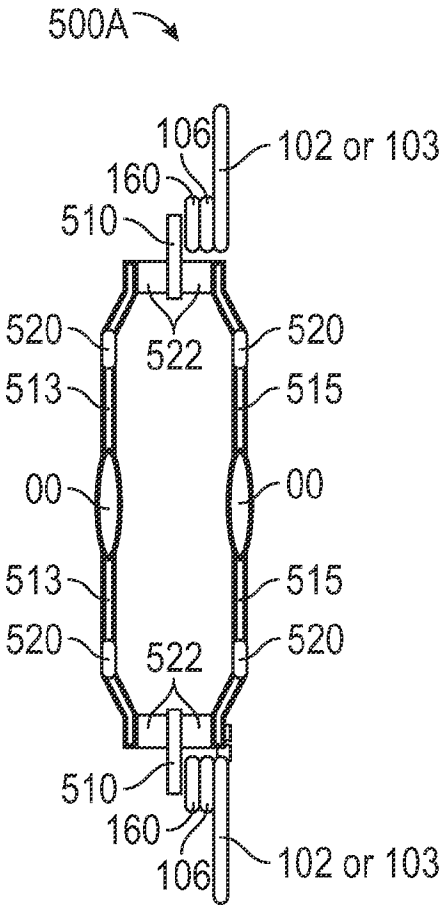

FIGS. 4A, 4B and 4C depict three CRD configurations which include a flat diaphragm, concave diaphragm and a convex diaphragm, respectively. Such configurations may cover or be disposed within a drum head void 00, the void defined by either a batter drum head 102 or a resonant drum head 103. A CRD may comprise a template ring 106, an external adjustable diaphragm wall 513, an internal diaphragm wall 515, spring suspension foam 520 and other components as numbered.

Figure 5C:
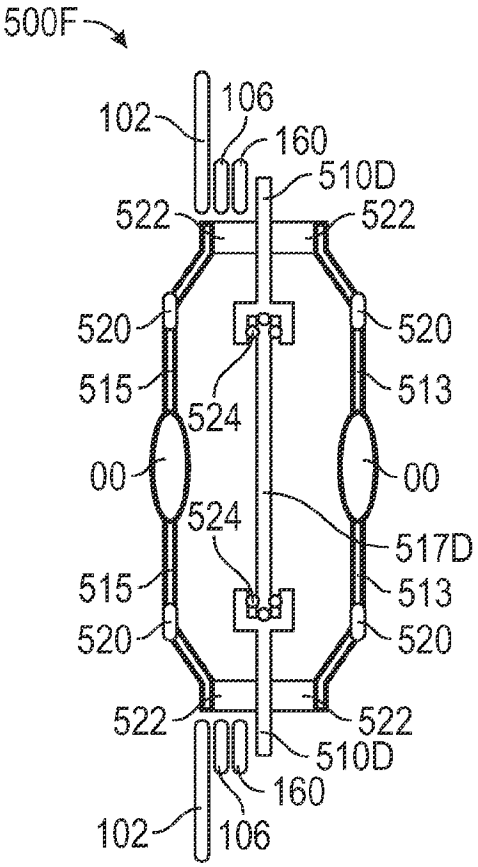
FIGS. 5A to 5C depict a various MCRD or CRD configurations
Figure 5B:
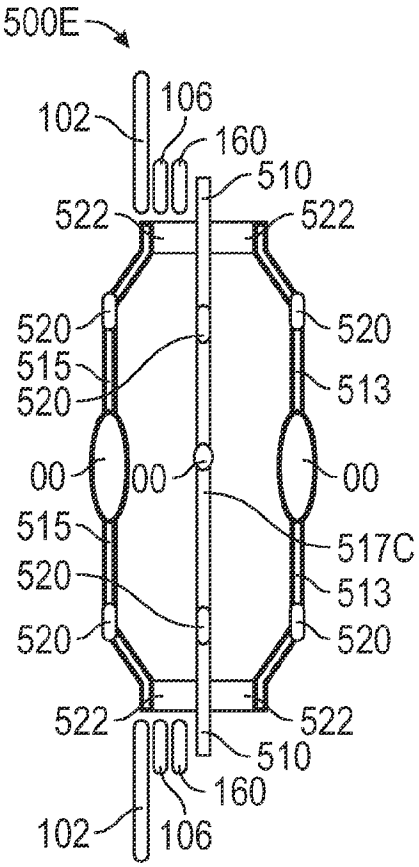
Figure 5A:
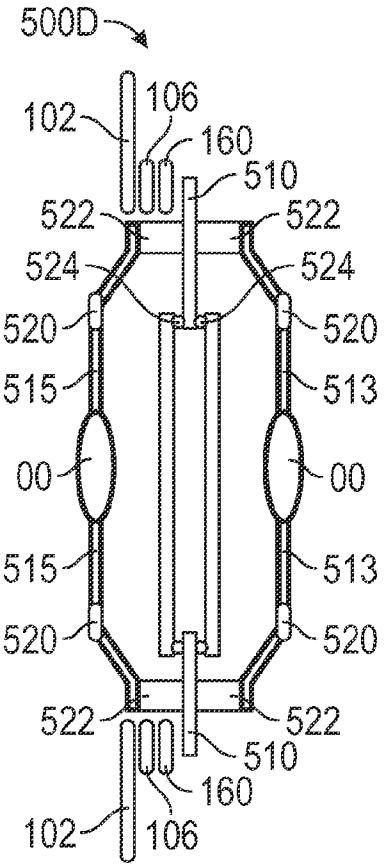

FIG. 5A to FIG. 5C depict three additional MCRD configurations with or without various spring or isolation elements and with one or more diaphragms. Such configurations may comprise a template ring 106, adhesive 160, support frame 510, support frame 510D with slotted end disk insert, external adjustable wall 513, internal diaphragm wall 515, center diaphragm A 517A, center diaphragm B 517B, isolation suspension 522, air passing suspension 524 and other components as shown and/or numbered.

Figure 6:
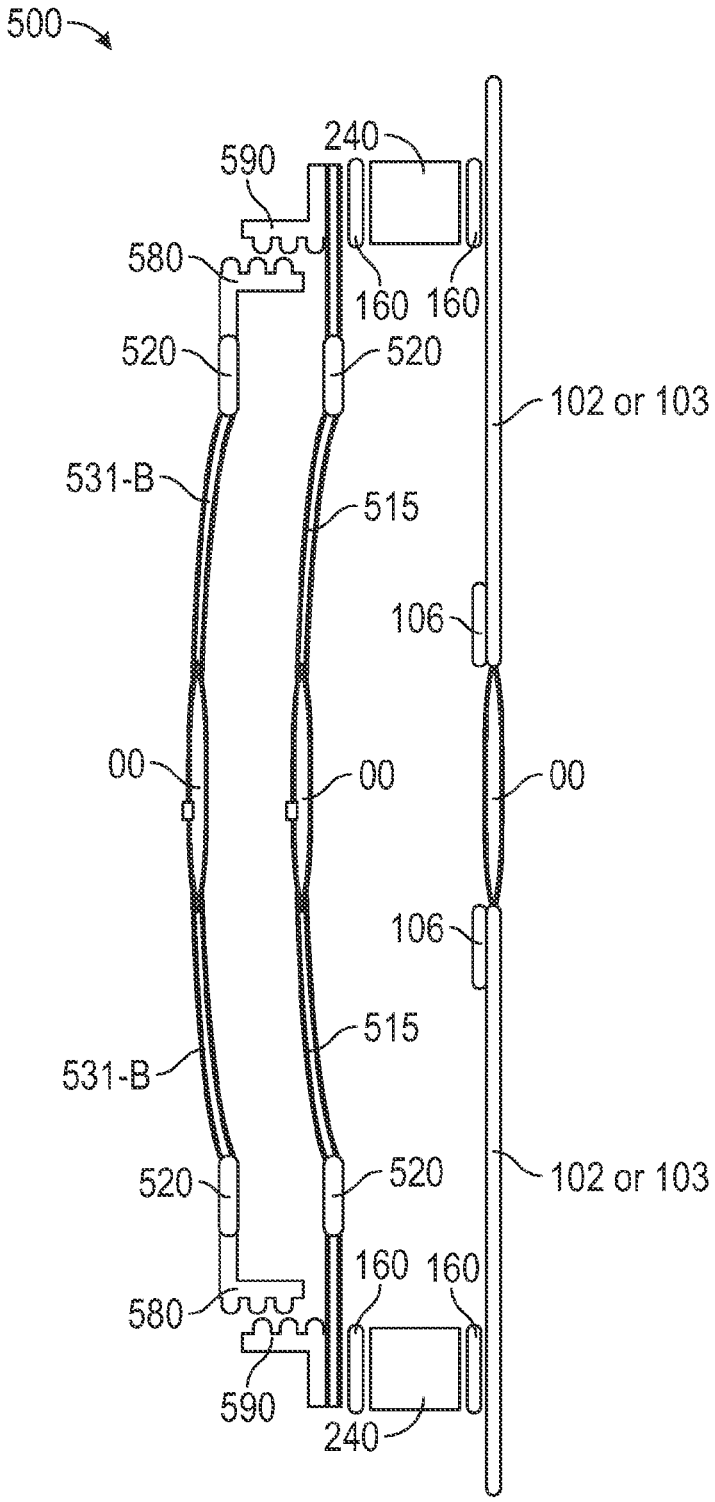
FIG. 6 depicts a compound resonance driver with adjustable features

FIG. 6 depicts a modulated and adjustable CRD with an internal diaphragm wall, external adjustable diaphragm wall quick stick riser body 240 and other features as shown.

Figure 7A:
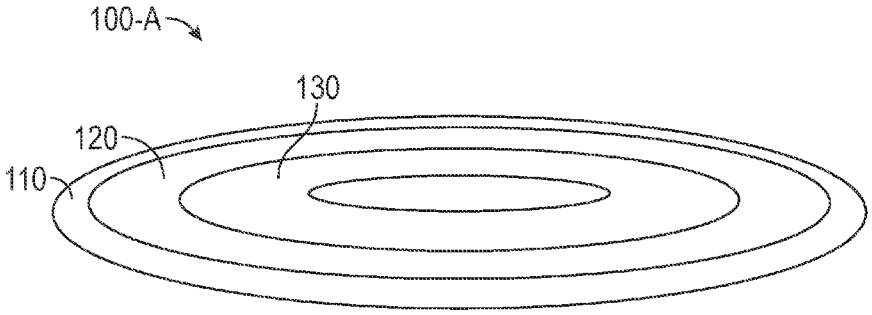
FIGS. 7A to 7D depict an excursion extender and related components
Figure 7B:
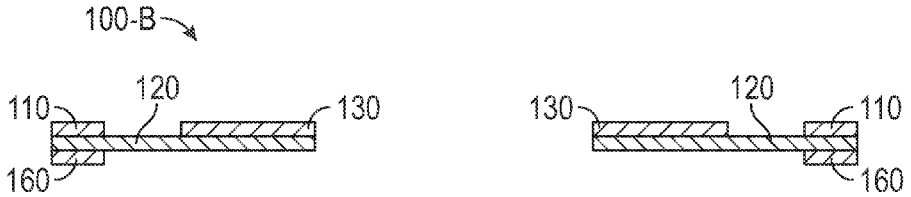
Figure 7C:
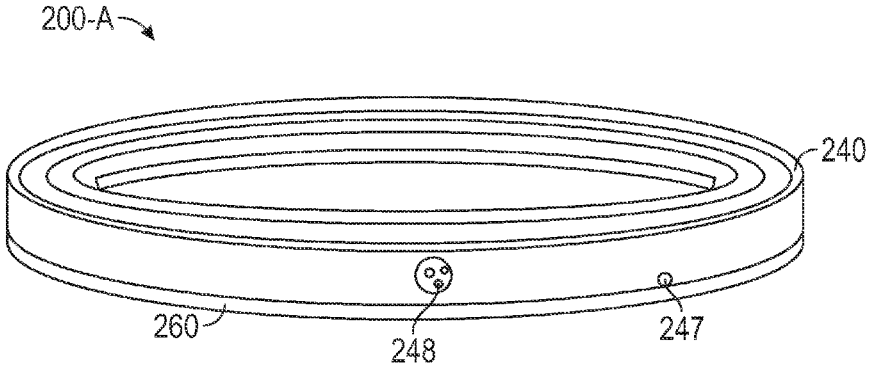
Figure 7D:
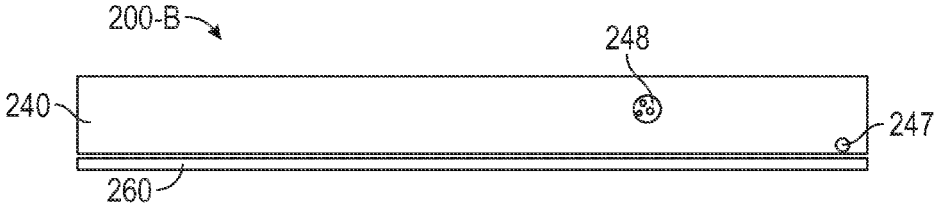

FIGS. 7A to 7C depict various features and attributes of an excursion extender and a quick stick riser. Such features include an outside ring 110, 120 neoprene 120 or other flexible material, an inside support ring or disk 130 and adhesive 160. A quick stick riser 200-A may comprise a mic connector 248, a riser ring body 240, adhesive 260 and a slot 247 for a mic cable.

Figure 8A:
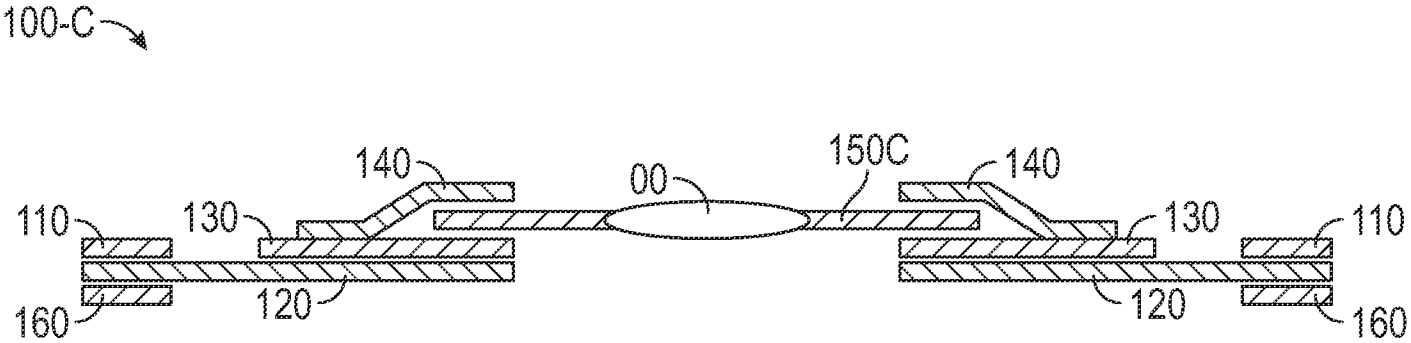
FIGS. 8A to 8B depict an excursion extender with a surgical rubber attachment holder
Figure 8B:
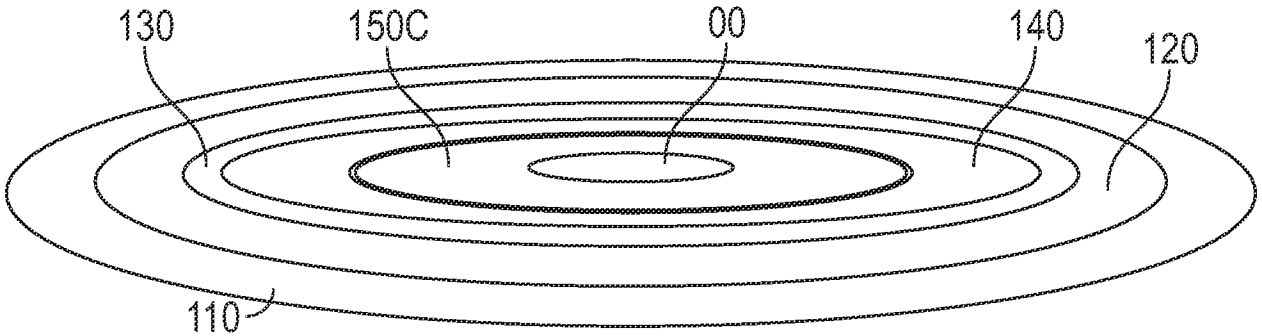

FIG. 8A and FIG. 8B depict various features of an excursion extender with a surgical rubber attachment holder. Such components may include an outside ring 110, a void or opening 00, neoprene 120, inside support ring or disc 130, rubber attachment holder 140, versatile multi-disk attachment 150C and adhesive 160.

Figure 9A:
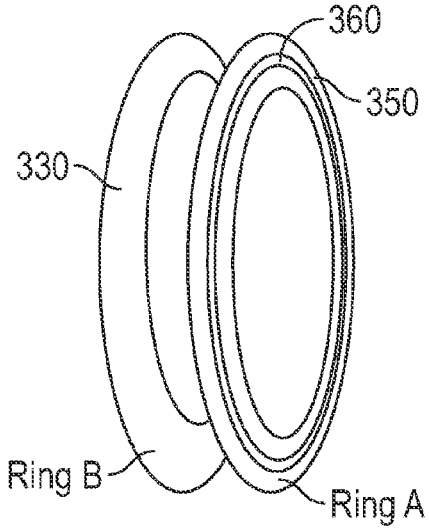
FIGS. 9A to 9C depict quick connect attachment rings and various related components.
Figure 9B:
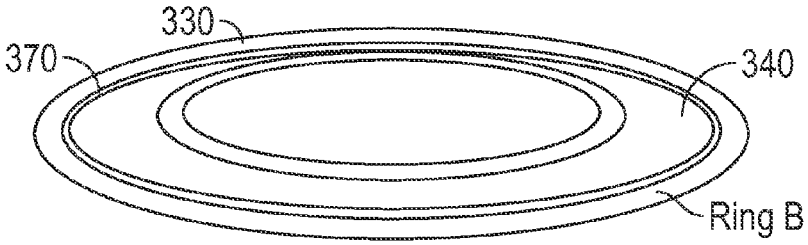
Figure 9C:
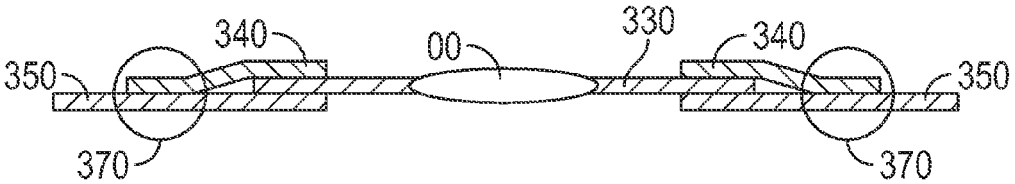

FIGS. 9A to 9C depict quick connect system components which may be used in addition or as a replacement for a template ring on a drum head. Ring A may act as a base ring. Ring A may stay upon a drumhead. Ring B may serve as a quick connect mount for any and all attachments. Ring B allows for numerous attachments, each may be mounted upon its own quick connect ring and quickly interchanged onto a base ring. Ring systems may comprise an A Ring or B Ring, quick connect disc 330, rubber overlap 340, adhesive, 360 and a bonding point 370 between rubber and disc.

Figure 10:
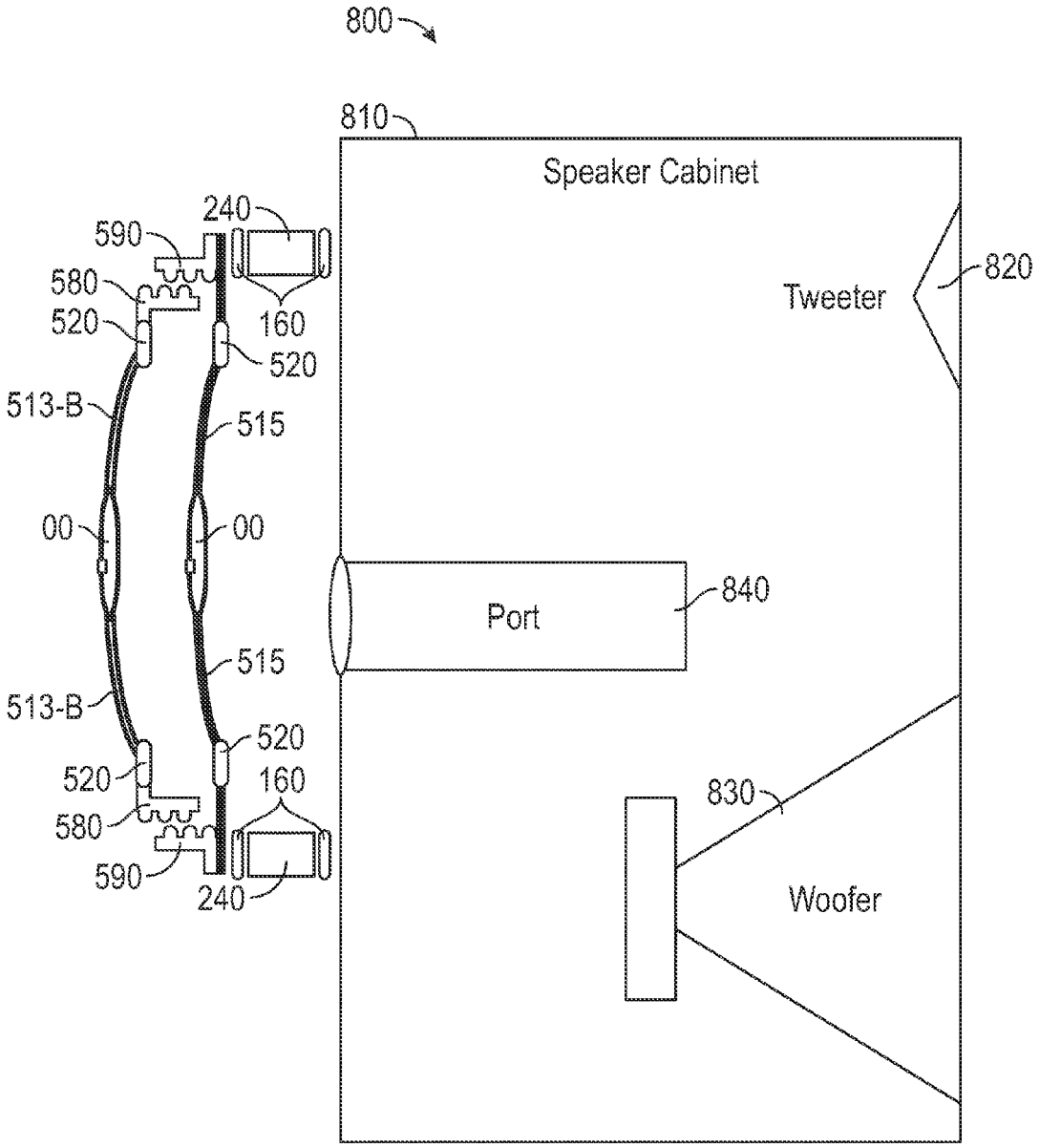
FIG. 10 depicts a MCRD or CRD mounted on a speaker cabinet over a port

FIG. 10 depicts a contemplated integration of a CRD with a speaker port. A CRD may be fitted upon speaker 800 and more particularly over a tweeter 820 or woofer 830 or port 840.

Figure 11:
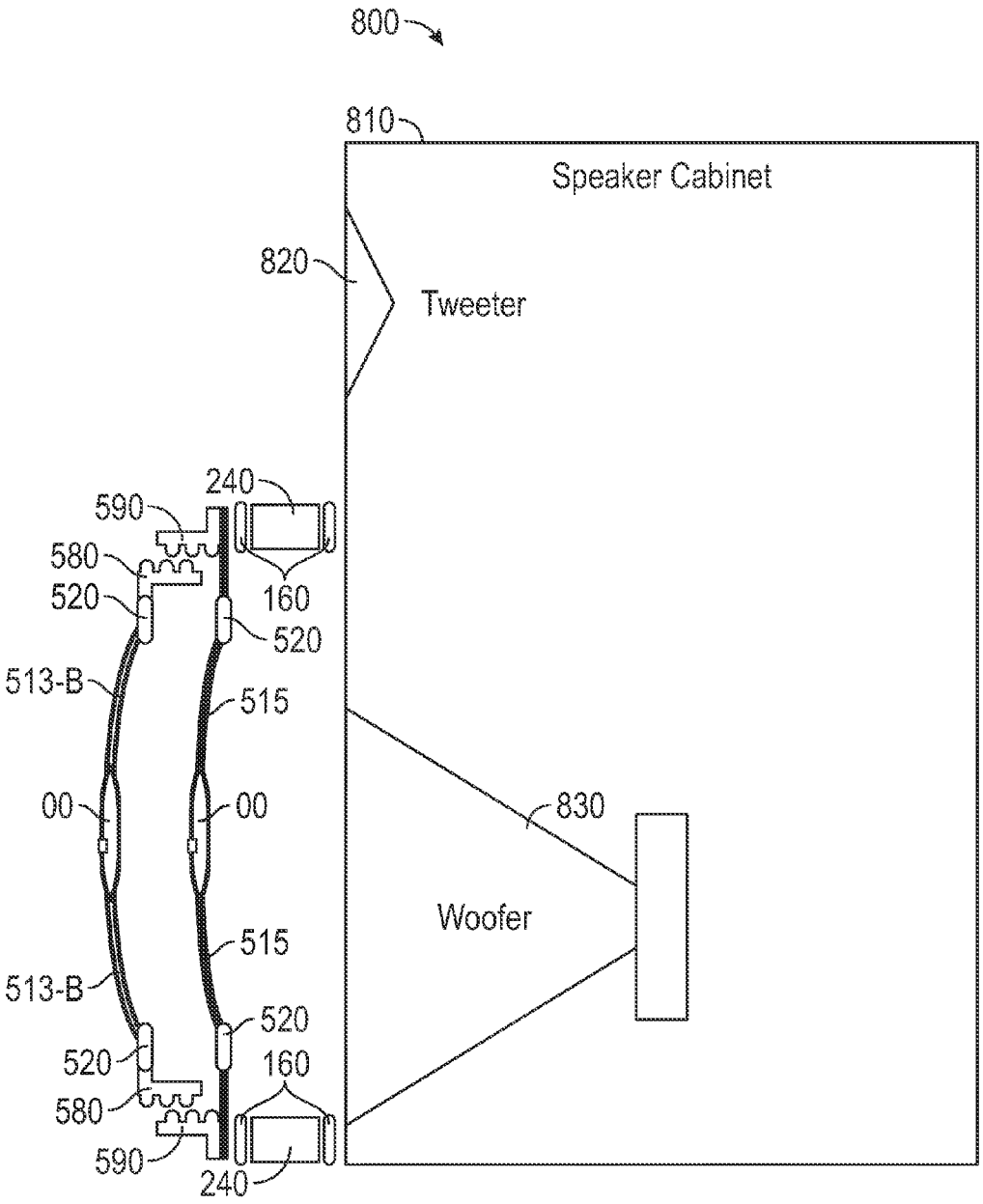
FIG. 11 depicts a MCRD or CRD and related components attached over the woofer section of a speaker cabinet

FIG. 11 depicts a contemplated integration of a CRD with a speaker woofer 830.

Figure 12A:
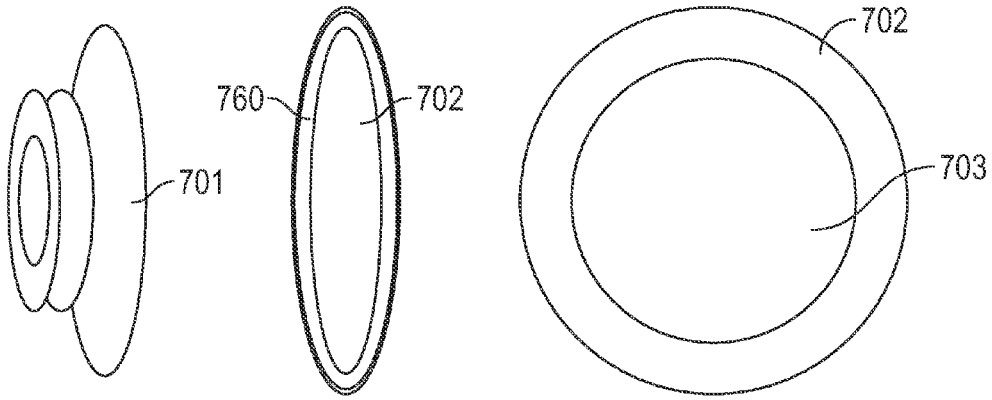
FIGS. 12A to 12C depict strike attachments and various components
Figure 12B:
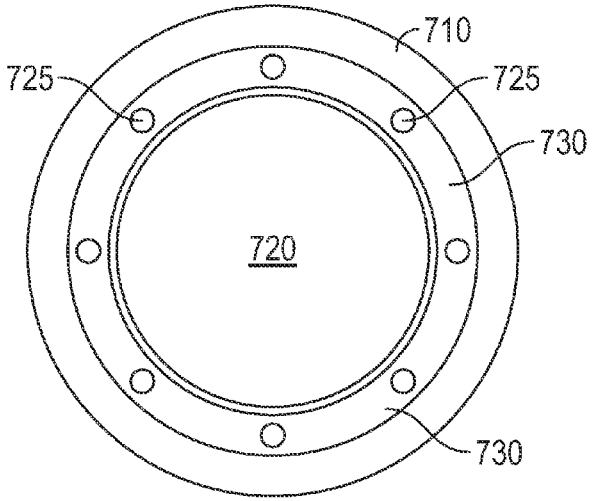
Figure 12C:
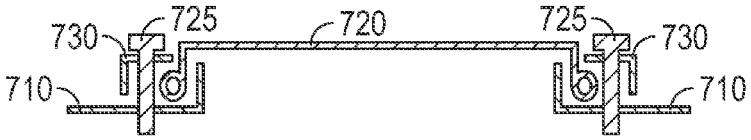

FIG. 12A to 12C depict various strike attachments and related components. Such components may include a membrane 700, support frame 710, lugs 725, membrane retainer 730, beater disc 702 and beater plug 701.

Figures 13A, 13B, 13C:
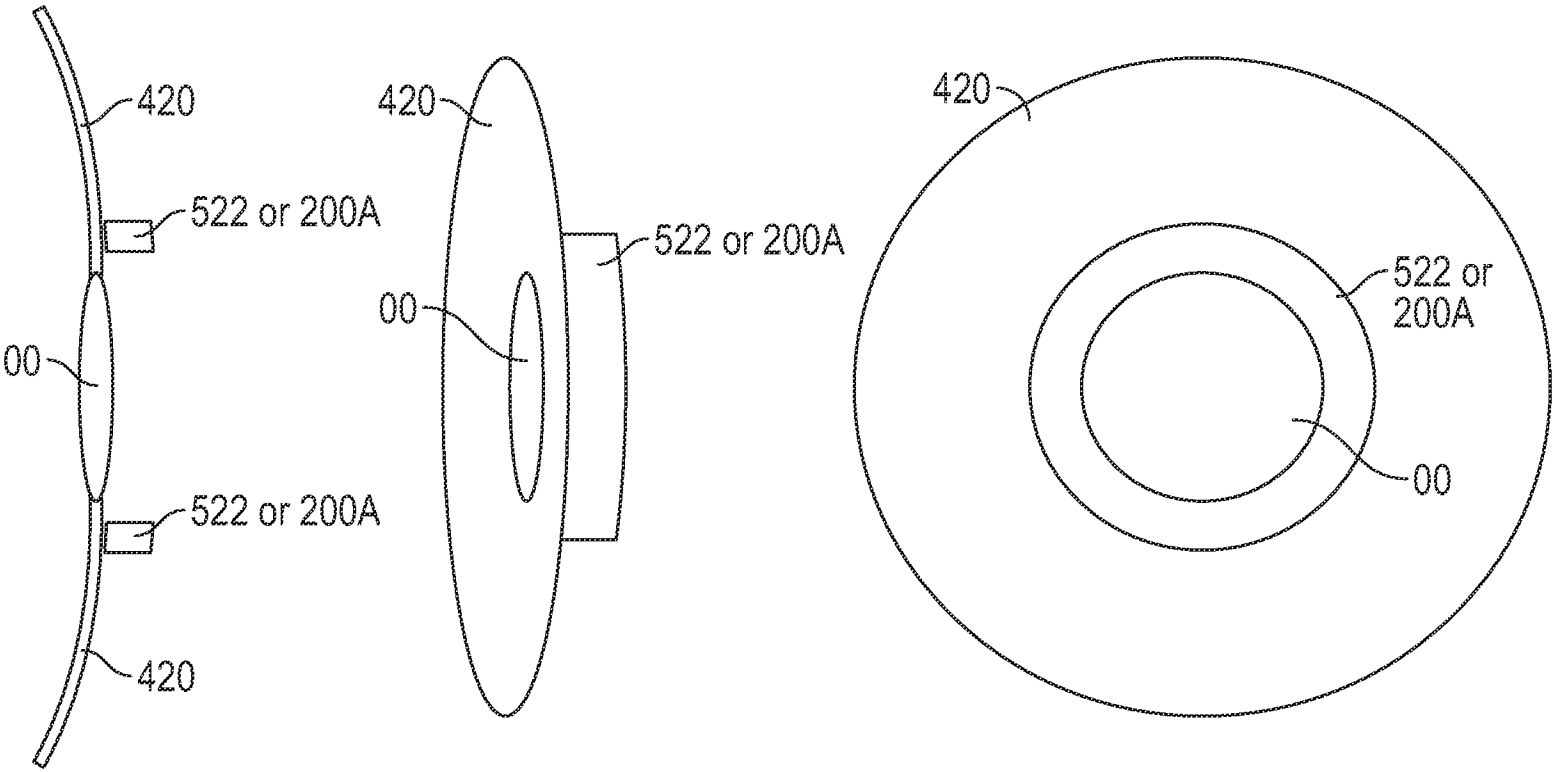
FIGS. 13A to 13C depict a sonic radiator dish and various related features

FIG. 13A to 13C depict a sonic radiator dish and related components. Such components may include a quick stick riser, dish 420, center void 00, isolation suspension foam 522 and other features. A sonic radiator dish may be mounded directly to a drum head or to an excursion extender.

Figure 14:
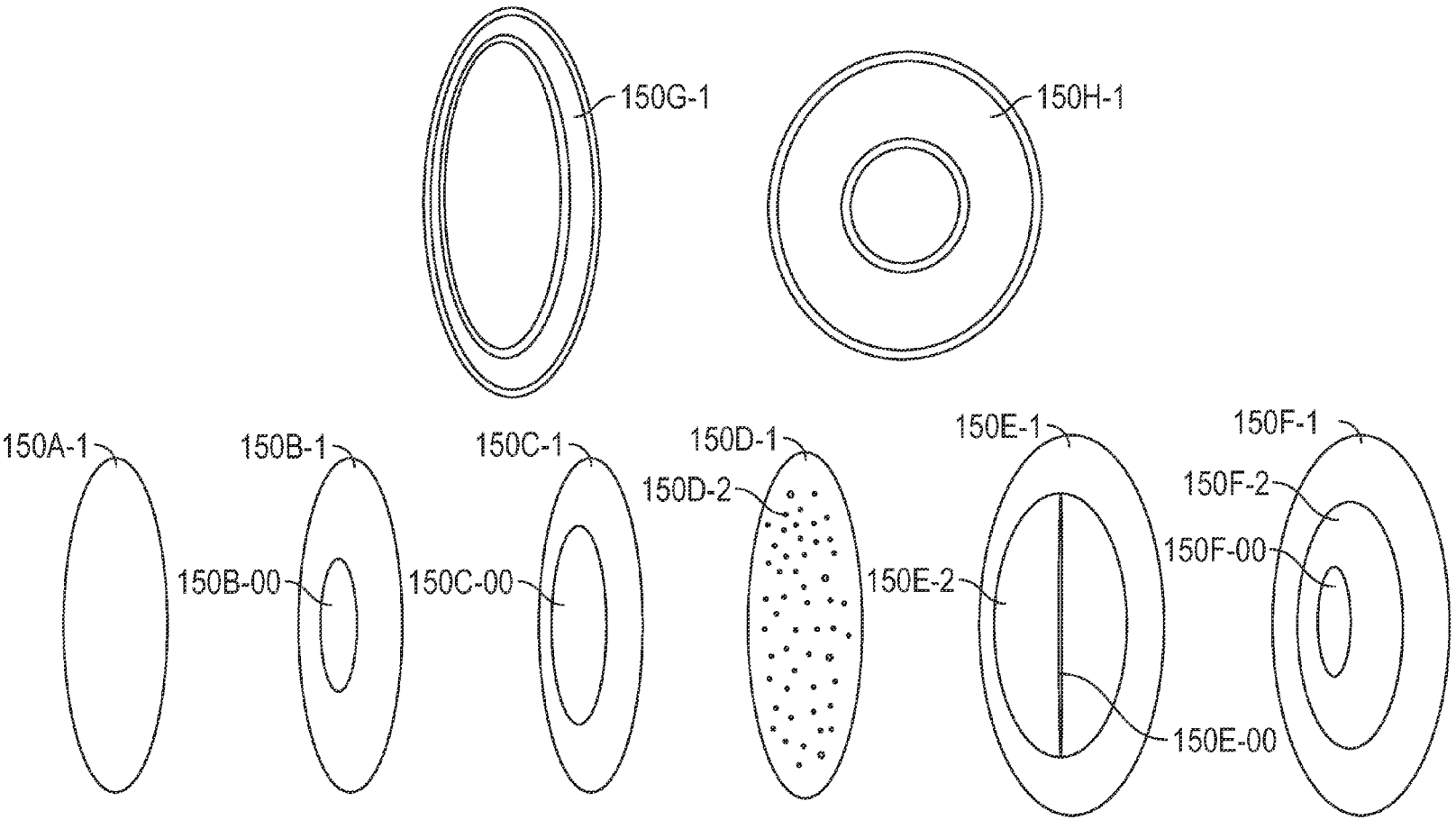
FIG. 14 depicts a multi disk attachment and related embodiments

FIG. 14 depicts various versatile multi-disks and various weight rings, rubber reeds, rubber dams and other components. Such components may include a weight ring 150G-1, a weight disc 150H-1, a solid multi-disc attachment 150A-1, a twin inch hole or void multi disc attachment 150B-1, four inch model 150C-1, EQ multi-disc attachment 150D-1, rubber reed model 150E-1 which may comprise a rubber reed 150E-2 and a rubber dam model 150E-1. The disclosed weight rings and discs may be made of metal or other types of material suited for adhesive, magnetic or other type of attachment. The disclosed rings may be of a variety of weights which optimize the mass of a CRD or other components.

Figure 15:
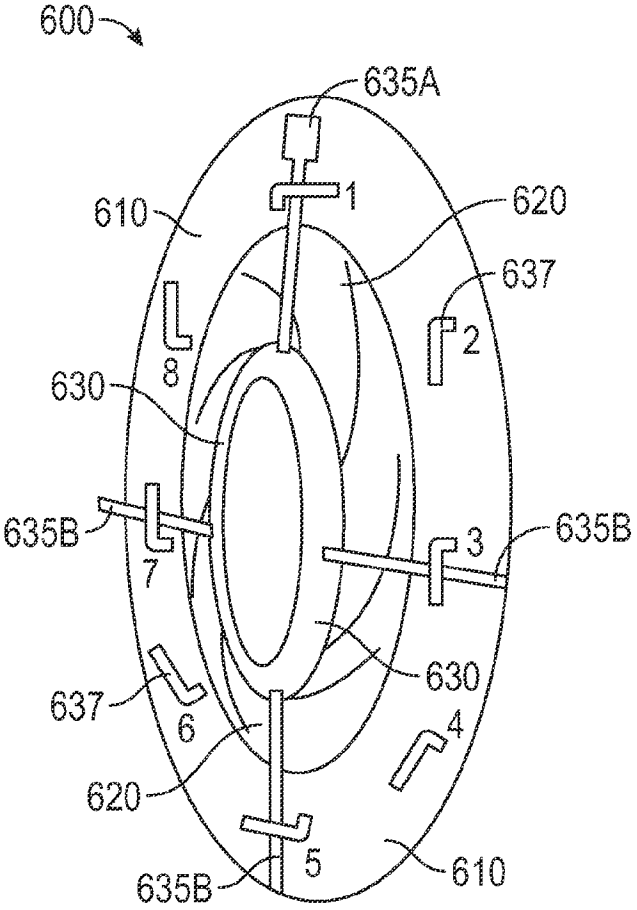
FIG. 15 depicts a sonic iris and various components

FIG. 15 depicts a sonic iris 600 multi-disk attachment and various related components. A sonic iris may be used like the other disclosed multi disk attachments and may comprise stretch material and an outer ring/disc and an inner adjustment ring disc. A sonic iris may comprise an outer ring 610, an iris film 620 made of surgical rubber, neoprene, or similar material; an inside adjustment ring 630, an amusement ring guide spar 635A, an adjustment ring spar 635B and numbered spar locks.

Figure 16:
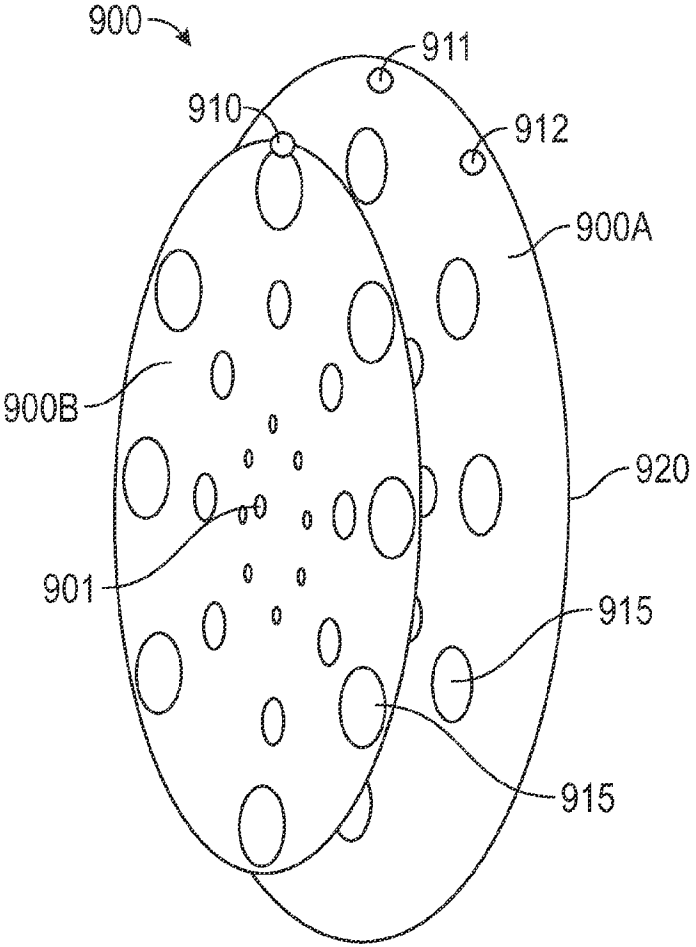
FIG. 16 depicts a sonic variable valve multi-disk attachment

FIG. 16 depicts a sonic variable valve multi-disk attachment 900 and various related components. Such components may include a valve position reference mark 910, a 900B rotating value disc a pivot point screw 901 on axis, an axis 920, an open mark 911, a closed mark 912, a main disc 900A, corresponding air valves 915.

Figure 17A:
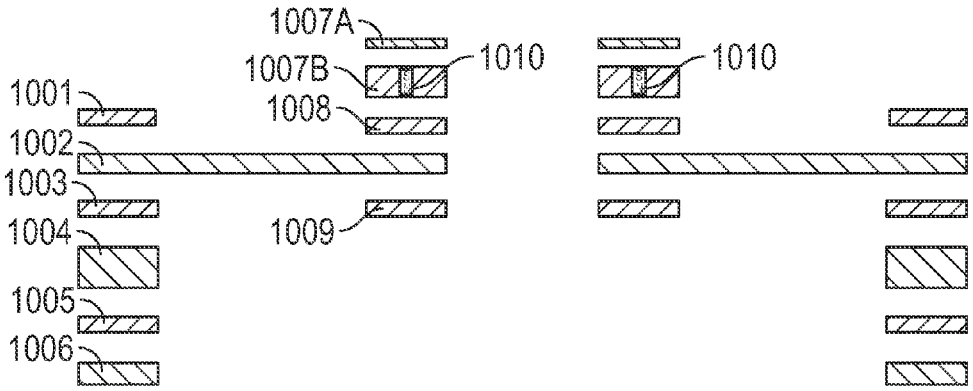
FIG. 17A depicts a sectional view of a boom CRD
Figure 17B:
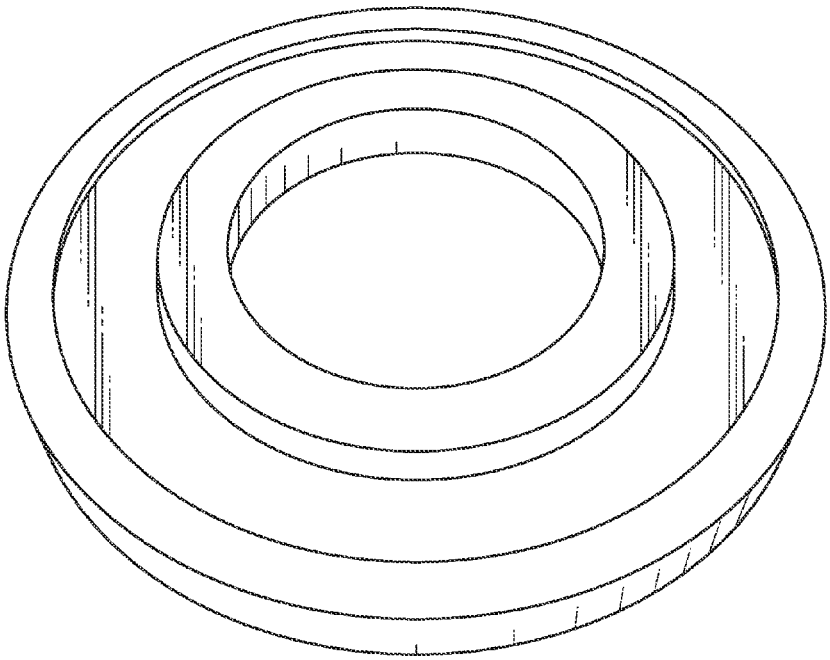
FIG. 17B depicts a perspective view of a CRD

FIG. 17A depicts a section view of a boom CRD and FIG. 17B depicts a perspective view of a boom CRD.

Figure 18:
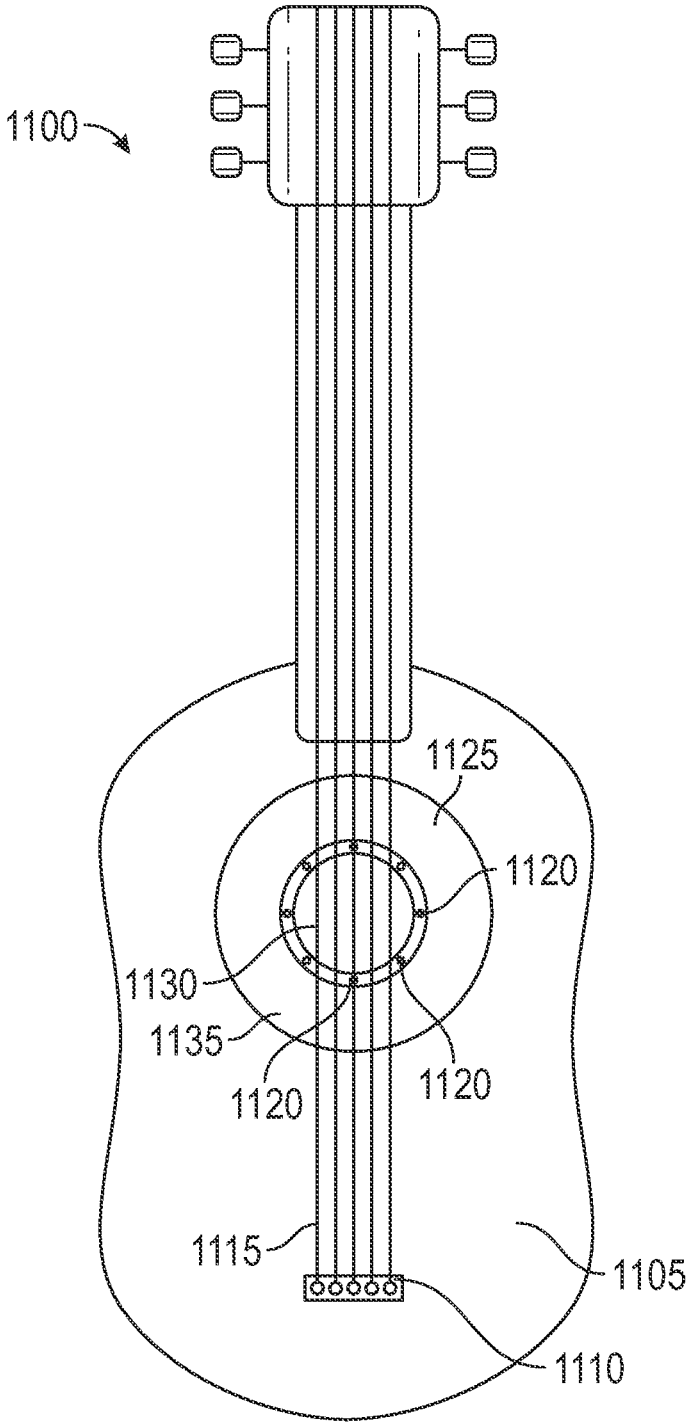
FIG. 18 depicts a disclosed embodiment attached to a guitar

FIG. 18 depicts a boom CRD disposed within a guitar 1100.

Figure 19:
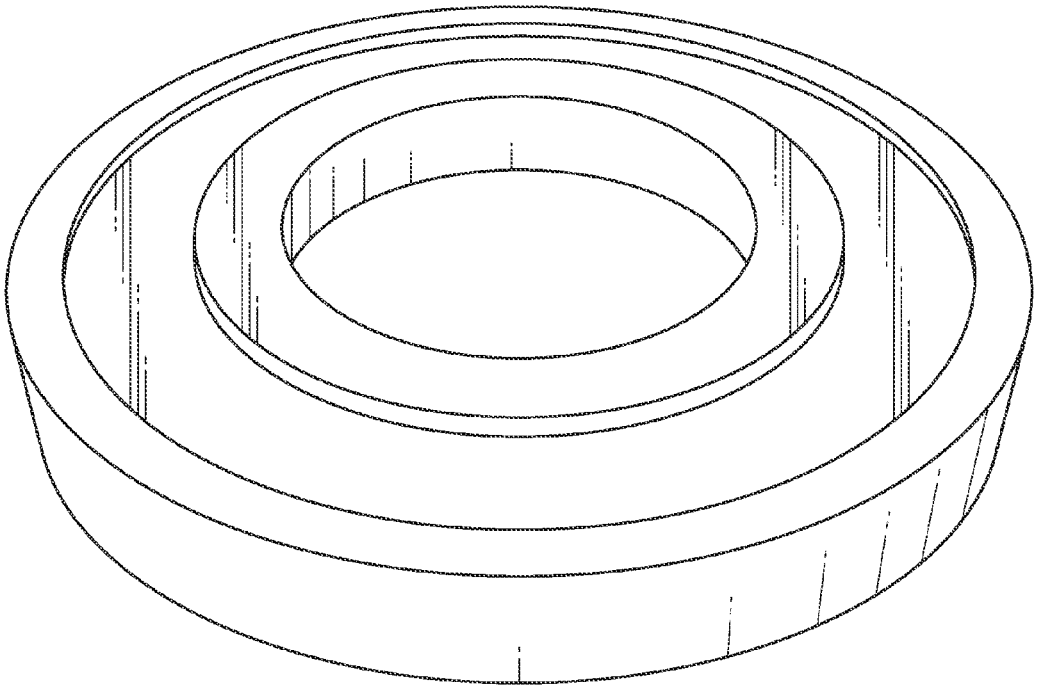
FIG. 19 depicts a perspective view of a CRD

FIG. 19 depicts a perspective view of a boom CRD.

Figure 20:
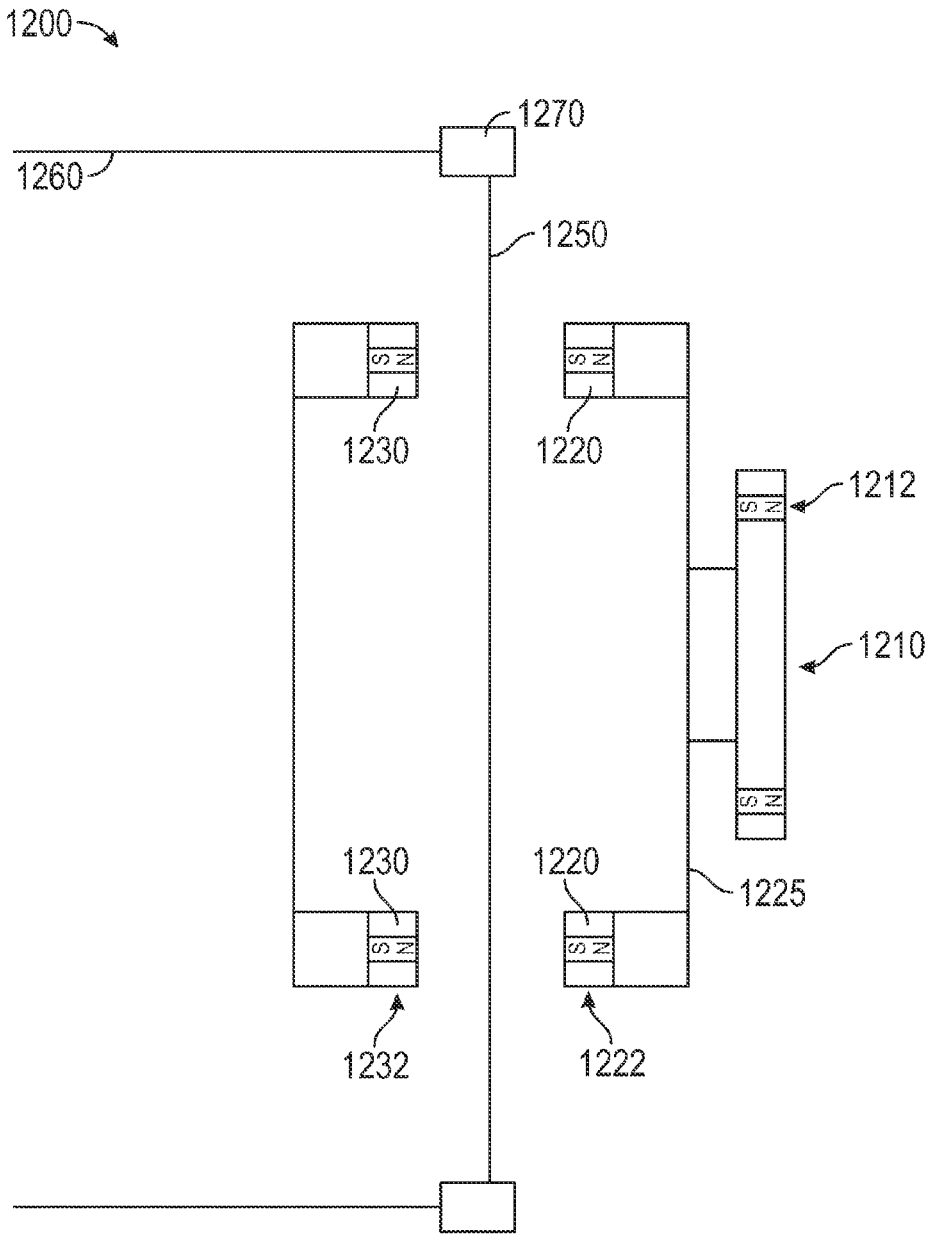
FIG. 20 depicts a sectional view of a magnetic coupling embodiment

FIG. 20 depicts a CRD system having a magnetic coupling system which may comprise a superior magna ring mount 1210 attached to the membrane 1225 of an exterior magna ring mount 1220. The exterior magna ring mount 1220 may be magnetically attached to an interior magna ring mount 1230. The interior magna ring mount 1230 may have magnets 1232 with a complementary North South orientation to attach to the magnets 1222 of the exterior manga ring mount 1220. The magnets 1212 of the superior magna ring mount may be positioned to repel the magnets 1222 of the exterior magna ring mount 1220. The repelling position of the magnets helps to achieve desired sonic qualities. For example, the magnetic orientation of the superior and exterior ring magnets transfer desired vibrations of the center ring to the outside ring, as well as transferring vibrations thought the membrane 1225.

Figure 21A:
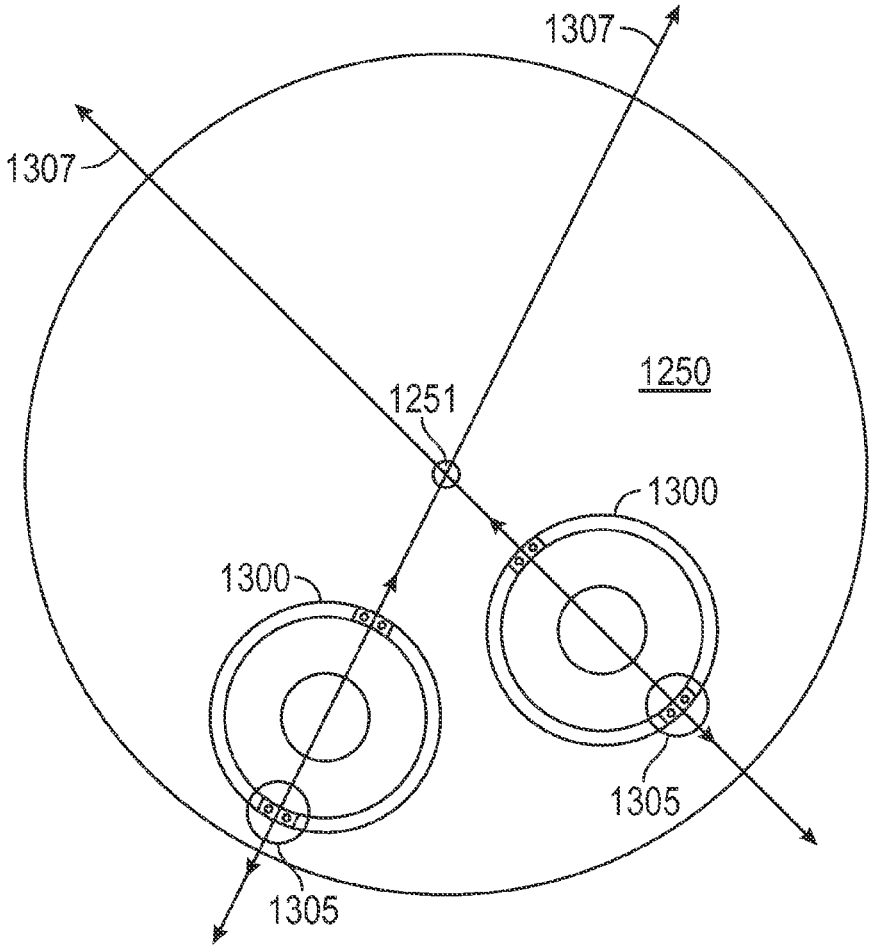
FIG. 21A depicts a plan view of a drum head

FIG. 21A depicts required placements of hinges 1305 of magna flex rings 1300.

Figure 21B:
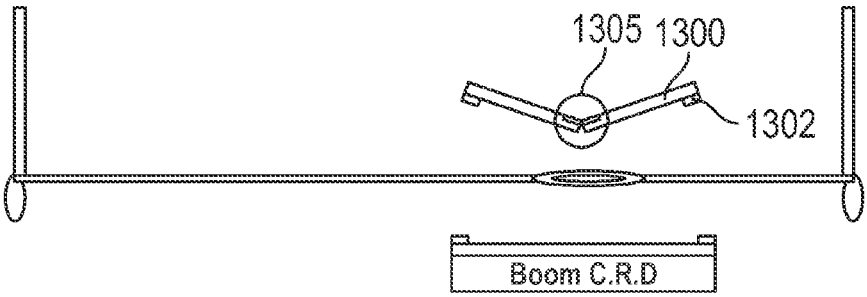
FIG. 21B depicts a side view of a flex ring disposed within a drum

FIG. 21B depicts components of a magna flex ring system.

Figure 22:
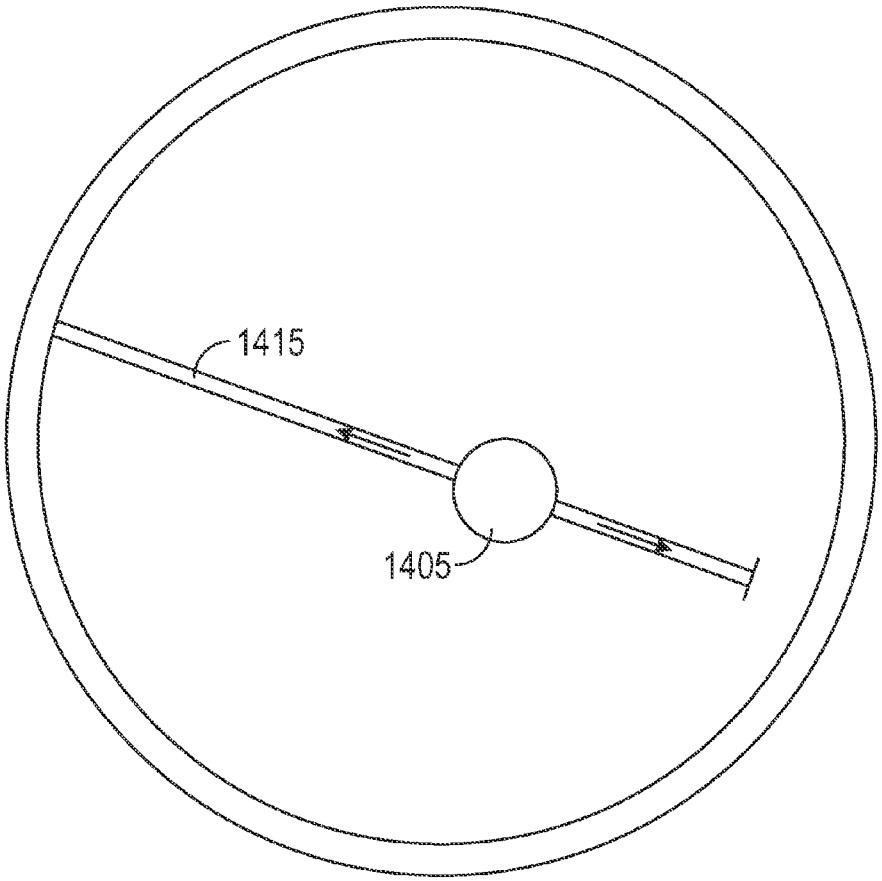
FIG. 22 depicts a plan view of a moveable weight embodiment

FIG. 22 depicts components of a movable weight system.

Figure 23:
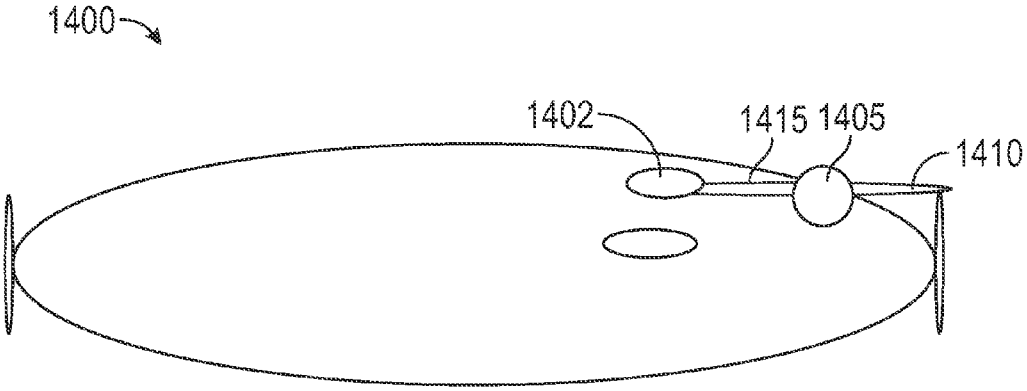
FIG. 23 depicts a perspective view of a moveable weight embodiment
Figure 24:
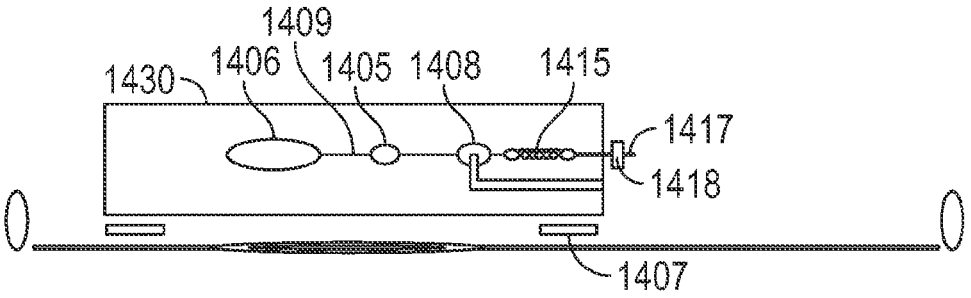
FIG. 24 depicts a sectional view of a moveable weight embodiment
Figure 25:
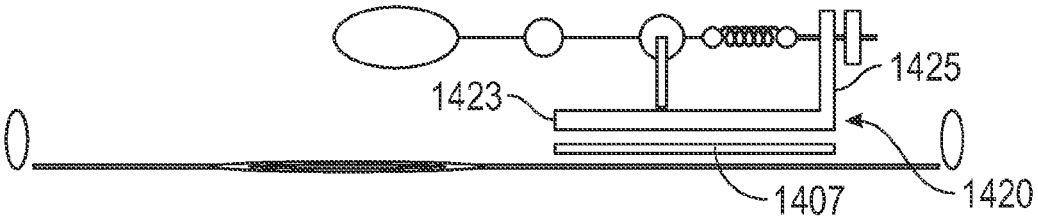
FIG. 25 depicts a sectional view of a moveable weight embodiment
Figure 26:
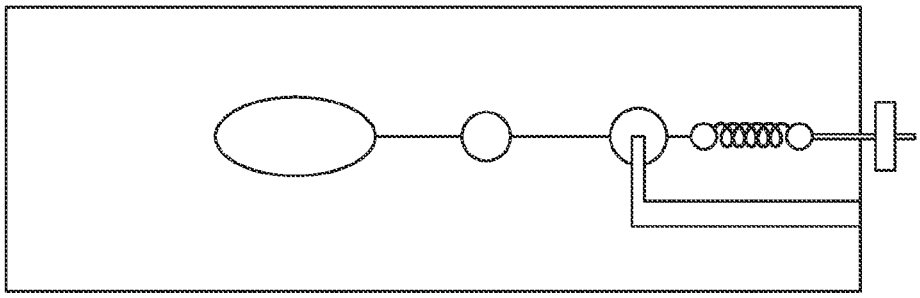
FIG. 26 depicts a sectional view of a moveable weight embodiment
Figure 27:
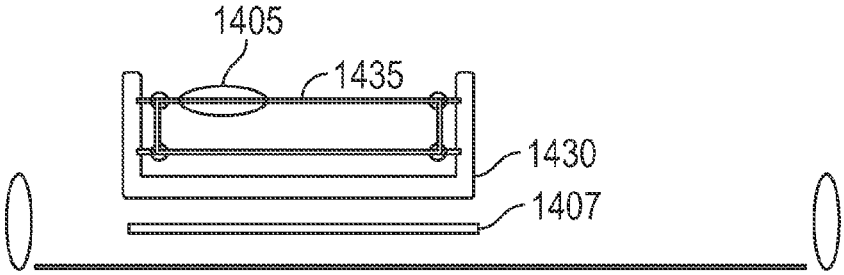
FIG. 27 depicts a sectional view of a moveable weight embodiment

FIG. 23 depicts a perspective view of a moveable weight system.

FIGS. 24 to 27 depicts disclosed moveable weight systems.

Figure 28:
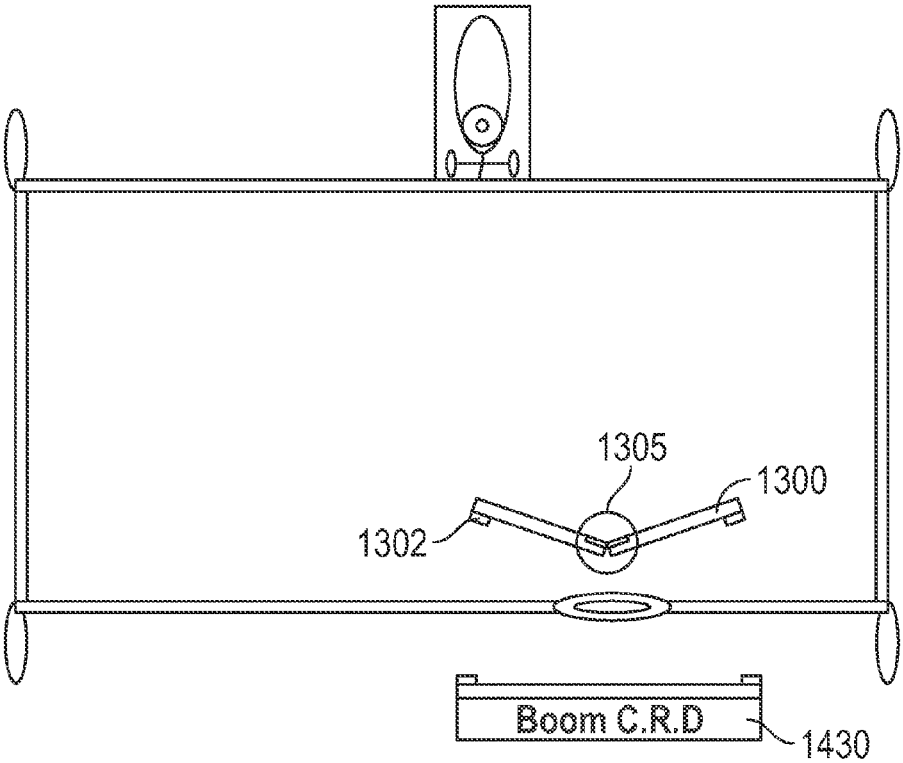
FIG. 28 depicts a plan view of a flex ring disposed within a drum

FIG. 28 depicts hinge system used with a boom CRD 1430.

Figure 29:
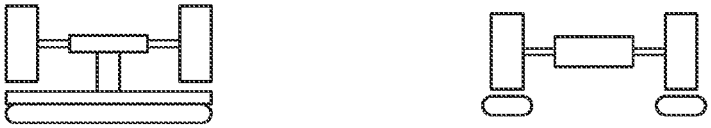
FIG. 29 depicts center mount and ring mount embodiments

FIG. 29 depicts a center and ring mount sonic spring system.

Figure 30:
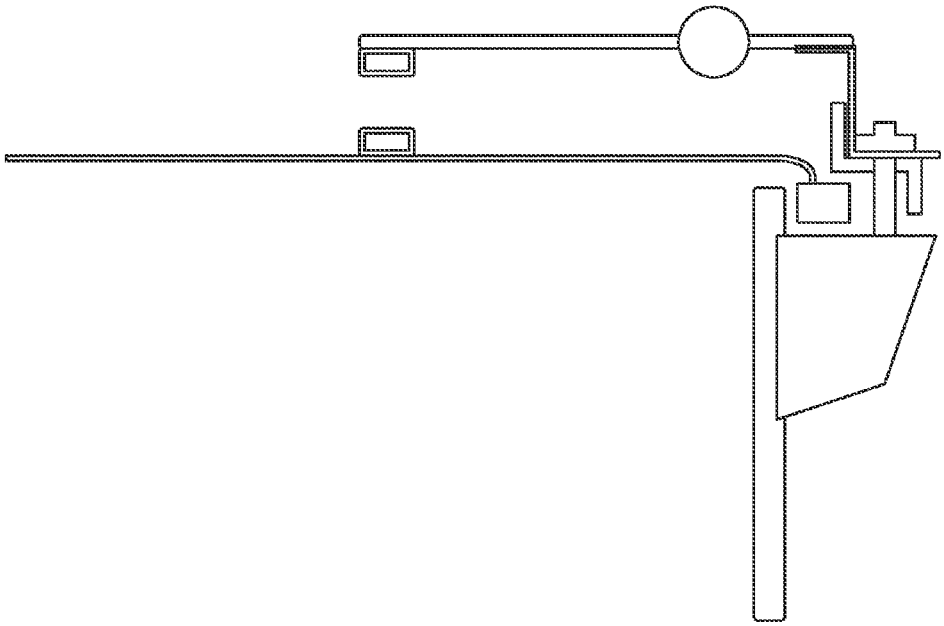
FIG. 30 depicts a sectional view of a ring mount embodiment

FIG. 30 depicts rim mount sonic spring system.

Figure 31:
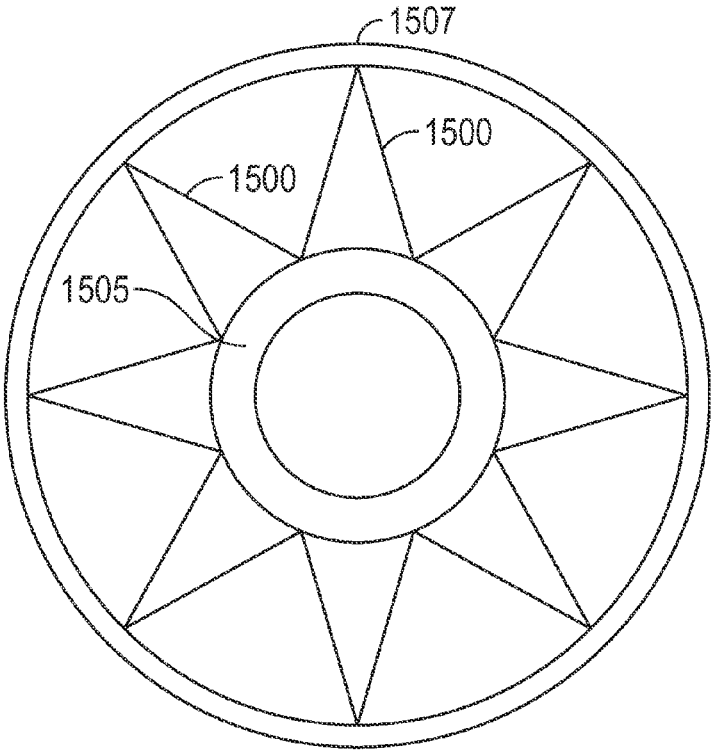
FIG. 31 depicts a plan view of a center weight suspension system

FIG. 31 depicts a support system for a center weight.

Disclosed embodiments may include the following items.

1. A compound resonance driver (CRD) for improving the tonal qualities of a drum or other membrane, the CRD comprising:

a) an inner magna flex ring comprising a circular component, the circular component comprising two hinges and a plurality of magnets;

b) a boom CRD comprising a fixed circular component the fixed circular component comprising an plurality of magnets in orientation complementary or attracted to the magnets of the magna flex ring;

c) the fixed circular component having a first side attached to an adhesive ring 1006, outside ring 1005, a foam ring 1004 and an center ring;

d) the fixed circular component having a second side attached to a outside ring 1001 and center ring 1008 with the center ring attached to a magna ring containing magnets and the magna ring attached to a neoprene gasket.

2. The CRD of 1 further comprising a superior magna ring mount 1210 attached to a membrane 1125 of the fixed flex ring.

3. The CRD of 2 further comprising magnets 1212 disposed within the superior manga ring mount with the magnets positioned to have opposing polarity with the magnets of the fixed ring.

4. The CRD of 3 wherein the hinges of the magna flex ring are aligned with axis lines crossing a center point of a drum membrane.

5. The CRD of 4 wherein the inner magna flex ring and the fixed circular component cover a circular void defined by a drum membrane.

The term "magna" may mean magnetic. The disclosed combinations of components achieve desired results in acoustic resonance.

What is claimed is:

1. A compound resonance driver (CRD) for improving tonal qualities of a drum or other membrane, the CRD comprising:

a) an inner flex ring comprising a circular component, the circular component comprising two hinges and a plurality of magnets;

b) a boom CRD comprising a fixed circular component the fixed circular component comprising a plurality of magnets in orientation complementary or attracted to the magnets of the flex ring;

c) the fixed circular component having a first side attached to an adhesive ring, outside ring, a foam ring and a center ring;

d) the fixed circular component having a second side attached to a second outside ring and a second center ring with the second center ring attached to a ring containing magnets and the ring containing magnets is attached to a neoprene gasket.

2. The CRD of claim 1 further comprising a superior ring mount attached to a membrane of the fixed circular component.

3. The CRD of claim 2 further comprising magnets disposed within the superior ring mount with the magnets disposed within the superior ring mount positioned to have opposing polarity with the magnets of the fixed circular component.

4. The CRD of claim 3 wherein the hinges of the flex ring are aligned with axis lines crossing a center point of a drum membrane.

5. The CRD of claim 4 wherein the inner flex ring and the fixed circular component cover a circular void defined by a drum membrane.

6. The CRD of claim 1 having a single elastic member securing and suspending the CRD to an outside surface of a drum head.

7. The CRD of claim 1 attached to string instrument.

8. The CRD of claim 4 and a second identical CRD with the first and second CRDs attached to a drum head, and with all hinges of the flex rings aligned with axis lines crossing the center point of the drum membrane.

* * * * *